United States Patent [19]

Melton

[11] 4,073,263

[45] Feb. 14, 1978

[54] LIQUID ADHESIVE COATING MACHINE

[76] Inventor: Baxter Wayne Melton, 509 Rahway Ave., Westfield, N.J. 07090

[21] Appl. No.: 684,474

[22] Filed: May 10, 1976

[51] Int. Cl.[2] ..... B05C 1/08

[52] U.S. Cl. ..... 118/249; 118/261

[58] Field of Search ..... 118/249, 224, 221, 261, 118/250

[56] References Cited

U.S. PATENT DOCUMENTS

| | | | |
|---|---|---|---|
| 1,191,537 | 7/1916 | Schall | 118/249 X |
| 1,341,311 | 5/1920 | Glines | 118/221 |
| 3,335,696 | 8/1967 | Faltin et al. | 118/6 X |
| 3,351,040 | 11/1967 | McCall | 118/249 |
| 3,742,903 | 7/1973 | Wheaton | 118/249 X |
| 3,752,114 | 8/1973 | Knight | 118/250 X |

*Primary Examiner*—John P. McIntosh
*Attorney, Agent, or Firm*—Daniel Jay Tick

[57] ABSTRACT

A support member has a trough formed therein at one end thereof extending from the top and from side to side and containing liquid adhesive. First and second rollers are rotatably mounted in the machine in closely spaced adjacent parallel relation with their axes disposed in a plane perpendicular to the top and bottom of the support member. The first roller is partially immersed in liquid adhesive in the trough. The second roller is positioned above the first. Each of the rollers has a cylindrical surface having a plurality of circular notches formed therein in next-adjacent equidistantly spaced relation. Each of the notches has a V-shaped cross-section whereby the surface of each roller is a sawtooth. A rotating device is affixed to one of the rollers for rotating it thereby rotating the other roller in the opposite direction and moving a sheet of material between the rollers in a direction parallel to the top of the support member. Liquid adhesive is simultaneously applied to one surface of the material via the first roller.

9 Claims, 12 Drawing Figures

LIQUID ADHESIVE COATING MACHINE

BACKGROUND OF THE INVENTION

The present invention relates to a liquid adhesive coating machine. More particularly, the invention relates to a liquid adhesive coating machine for coating pressure sensitive adhesive on one surface of a sheet of material.

It is necessary, in making graphic arts mockups, layouts, or the like, to removably affix photographs, written material, pictures, and so on, to a background sheet of material such as, for example, paper, first in preselected positions, and then in other positions. It is often necessary to reposition the photographs, written material, pictures, and so on, third, fourth, or more, times, before a desired pattern or layout is attained. Each photograph, written piece, picture, and so on, must thus be removably affixed to the background sheet, so that heretofore adhesives, of which only permanently bonding liquid adhesives are known, have not been used for this purpose.

Heated wax coaters are used in the graphic arts field to removably affix desired material to a background sheet. This involves great expense, since the wax coating equipment is expensive and consumes considerable electrical energy in heating wax as part of its operation. The wax coaters utilize heating elements, thermostats, motors and switches, which are subject to breakdown and require costly maintenance and repair. Furthermore, the wax coaters consume considerable time in melting the wax.

The principal object of the invention is to provide a liquid adhesive coating machine for applying a pressure sensitive liquid adhesive to a sheet of material thereby permitting items to be affixed to the sheet of material for any desired period of time and permitting separation of the items from the sheet of material without damage to either the items or the sheet of material.

An object of the invention is to provide a liquid adhesive coating machine or simple, but sturdy structure.

Another object of the invention is to provide a liquid adhesive coating machine which is inexpensive in manufacture and in operation.

Still another object of the invention is to provide a liquid adhesive coating machine which requires minimal maintenance.

Yet another object of the invention is to provide a liquid adhesive coating machine which is completely devoid of heating elements, thermostats, motors and switches and does not consume electrical energy.

Another object of the invention is to provide a liquid adhesive coating machine which is assembled and disassembled with great rapidity, facility, convenience and ease.

Still another object of the invention is to provide a liquid adhesive coating machine which is cleaned with facility, convenience and rapidity.

Yet another object of the invention is to provide a liquid adhesive coating machine which functions efficiently, effectively, reliably and rapidly to provide pressure sensitive liquid adhesive to a sheet of material.

Another object of the invention is to provide a liquid adhesive coating machine which is operated with convenience, facility and ease.

BRIEF SUMMARY OF THE INVENTION

In accordance with the invention, a liquid adhesive coating machine for coating pressure sensitive liquid adhesive on one surface of a sheet of material, comprises a support member having a length, a width, a depth, a top, a bottom, a pair of spaced opposite ends and a pair of spaced opposite sides, and a trough formed therein at one end thereof extending from the top and from side to side, said trough containing liquid adhesive. First and second rollers are rotatably mounted in the machine in closely spaced adjacent parallel relation with their axes disposed in a plane perpendicular to the top and bottom of the support member. The first roller is partially immersed in liquid adhesive in the trough and the second roller is positioned above the first. Each of the first and second rollers has a substantially cylindrical surface having a plurality of substantially circular notches formed therein in next-adjacent equidistantly spaced relation. Each of the notches has a substantially V-shaped cross-section whereby the surface of each of the first and second rollers is a substantial sawtooth. A rotating device is affixed to one of the rollers for rotating said one of said rollers thereby rotating the other of the rollers in the opposite direction and moving a sheet of material between the rollers in a direction parallel to the top of the support member and simultaneously applying liquid adhesive to one surface of the material via the first roller.

The outer surface of each of the first and second rollers between the notches therein is rounded and the rounded outer surfaces of the first and second rollers are substantially coplanarly aligned.

A blade device is mounted in operative proximity with the first roller for cleaning the notches thereof to prevent a buildup of adhesive therein and to control the thickness of the coating of adhesive applied to the sheet of material.

A tray containing liquid adhesive is removably disposed in the trough. The first roller is rotatably mounted in the tray and the second roller is rotatably mounted in the support member.

The first roller is approximately half immersed in liquid adhesive in the tray.

The rotating device comprises a manually rotatable handle affixed to the second roller for rotating the second roller.

Slots formed in the sides of the tray rotatably support the first roller. Apertures formed in the sides of the support member rotatably support the second roller.

A humidity device is mounted on the support member in operative proximity with the first roller for providing humidity to slow down the drying out of the surfaces of the first roller.

The humidity device comprises a frame supported on the sides of the support member over the second roller and extending to operative proximity with the first roller and sponges mounted in the frame. The sponges are moistened and thereby provide the required humidity for the first roller.

BRIEF DESCRIPTION OF THE DRAWINGS

In order that the invention may be readily carried into effect, it will now be described with reference to the accompanying drawings, wherein.

In the figures, the same components are identified by the same reference numerals.

DETAILED DESCRIPTION OF THE INVENTION

Figure 2:
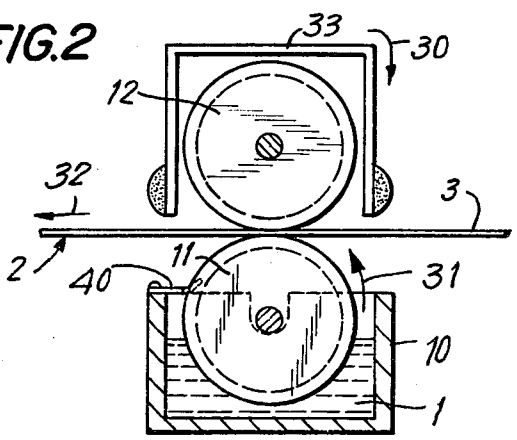
FIG. 2 is a view, partly in section, of the part shown in FIG. 1, at right angles to the view of FIG. 1 and includes the humidity device of the invention.
Figure 10:
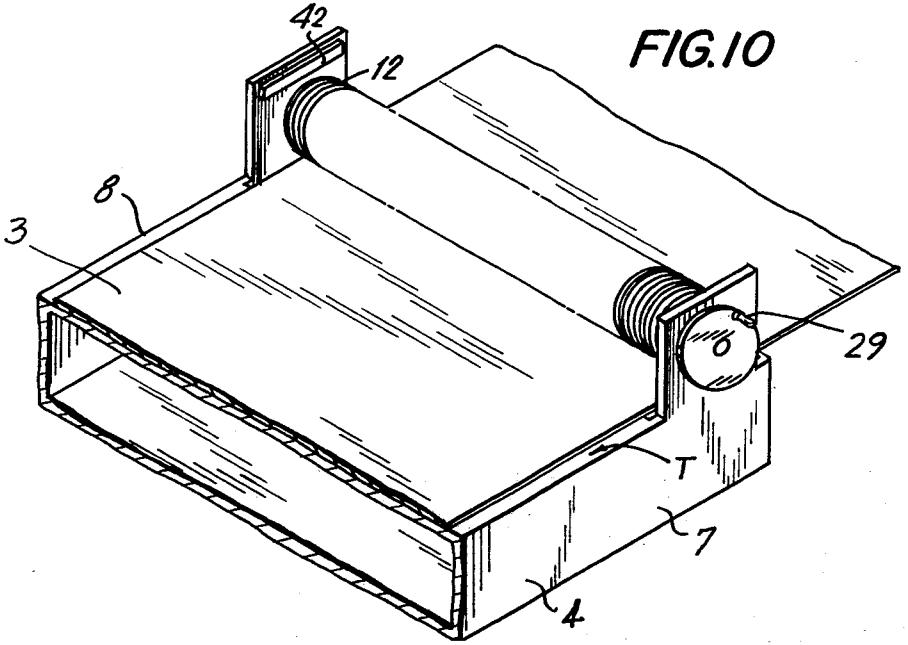
FIG. 10 is a perspective view of part of the liquid adhesive coating machine of the invention.

The liquid adhesive coating machine of the invention is for coating pressure sensitive liquid adhesive 1 (FIGS. 1, 2 and 4) on one surface 2 (FIG. 2) of a sheet of material 3 (FIGS. 2 and 10). The adhesive 1 may comprise any suitable liquid adhesive.

A suitable liquid adhesive. comprises a mixture of 50% by weight of water with 50% by weight of solid material. The solid material consists of "Hycar", which is a commercially available high carbon content acrylic latex produced by the B.F. Goodrich Chemical Company of Cleveland, Ohio, and a synthetic anionic emulsifier, commercially available from th B.F. Goodrich Chemical Company of Cleveland, Ohio, as "Hycar 2600×104". Hycar is an anionically stabilized colloidal dispersion in water of an acrylate ester polymer characterized by a glass transition temperature of −15° C.

The solid material consists of 48 to 51% by weight of the high carbon acrylic latex and 1 to 3% by weight of the synthetic anionic emulsifier.

Alkyd-phenolic derivative is added to the mixture of water and solid material in the proportion of 0.5 to 2.0 parts by gram weight to 100.0 parts by gram weight of the mixture. Preferably, 0.5 to 1.0 parts by gram weight of phenolic derivative is added to 100.0 parts by gram weight of the mixture. The phenolic derivative is commercially available as "Troykyd Special" and is produced by the Troy Chemical Company of Newark, New Jersey.

Antifoam silicone emulsion is added to the mixture of water and solid material in the proportion of 0.10 to 0.50 parts by gram weight to 100.0 parts by gram weight of the mixture. Preferably, 0.25 parts by gram weight of antifoam silicone emulsion is added to 100.0 parts by gram weight of the mixture. The antifoam silicone emulsion is commercially available from the Stauffer Chemical Corp. of Westport, Conn., as "SWS-211 Silicone".

The high carbon acrylic latex functions to provide adhesion. The synthetic anionic emulsifier functions to keep the latex in solution and to slow down skinning. The alkyd-phenolic derivative functions to keep skinning down to a minimum.

The antifoam silicone emulsion functions to keep the foaming of the water based Hycar down to a minimum.

The liquid adhesive bonds any two materials such as, for example, paper, plastic, cloth or fabric, or the like, for any desired period of time and then permits separation of the materials without damage to either.

The time of evaporation determines if the liquid adhesive provides a permanent bond or a pressure-sensitive bond. A permanent bond is provided when there is no evaporation time. A pressure-sensitive bond is provided when there are at least 45 seconds of evaporation. The operator of the machine must thus permit the copy to dry for a minimum of 45 seconds.

Figure 1:
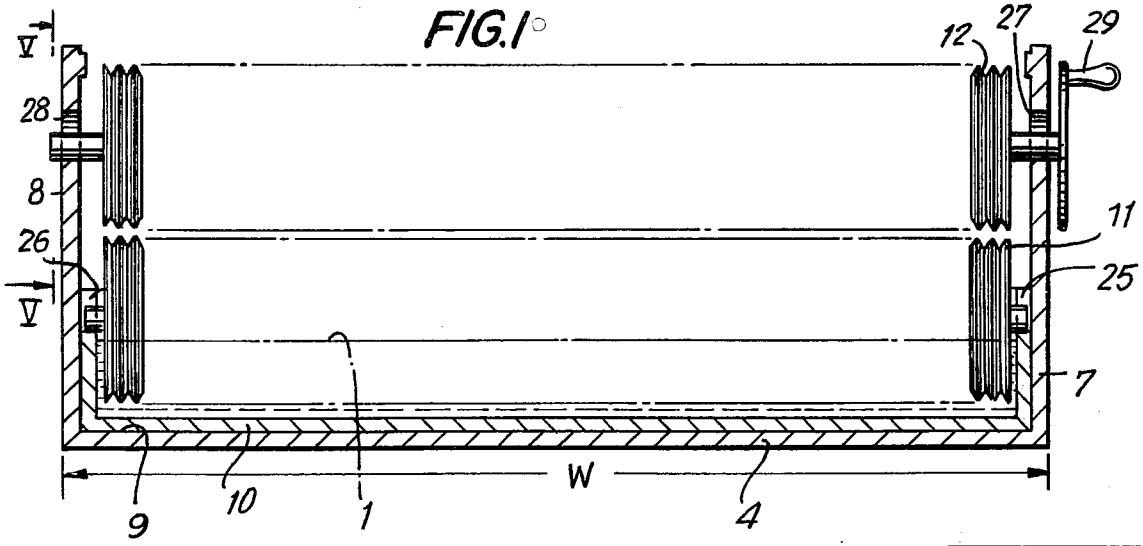
FIG. 1 is a view, partly in section, of part of an embodiment of the liquid adhesive coating machine of the invention.

The liquid adhesive coating machine of the invention comprises a support member 4 (FIGS. 1, 4, 5 and 10) having a length L (FIG. 4), a width W (FIG. 1), a depth D (FIG. 4), a top T (FIG. 4), a bottom B (FIG. 4), a pair of spaced opposite ends 5 and 6 (FIG. 4) and a pair of spaced opposite sides 7 and 8 (FIG. 1).

Figure 4:
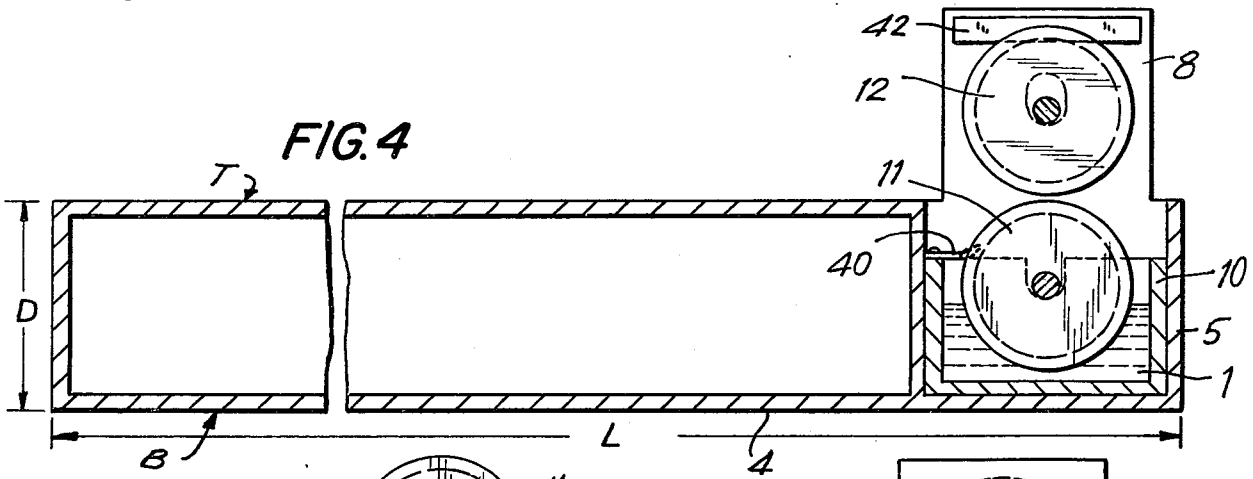
FIG. 4 is a view, partly in section, of the embodiment of FIG. 1 taken along its length.
Figure 5:
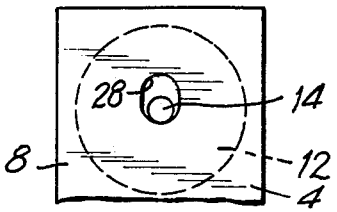
FIG. 5 is a view, on an enlarged scale, taken along the lines V—V, of FIG. 1.

A trough 9 is formed in the support member 4 at the end 5 thereof and extends from the top T and from side 7 to side 8 (FIGS. 1 and 4). A tray 10 (FIGS. 1 to 4) containing the liquid adhesive 1 is removably disposed in the trough 9 (FIGS. 1 and 4).

First and second rollers 11 and 12 (FIGS. 1, 2, 4 and 6) are rotatably mounted in slots formed in the sides of the tray 10 (FIGS. 1 and 3) and in the sides 7 and 8 (FIG. 1) of the support member 4, respectively, in closely spaced adjacent parallel relation. The axes 13 and 14 of the first and second rollers 11 and 12, respectively (FIG. 6), are disposed in a plane perpendicular tO the top T and bottom B of the support member 4, as shown in FIGS. 1, 2 and 4.

The first roller 1 is approximately half immersed in the liquid adhesive 1 in the tray 10, as shown in FIGS. 1, 2 and 4. The second roller 12 is positioned above the first, as shown in FIGS. 1, 2, 4 and 6.

Figure 6:
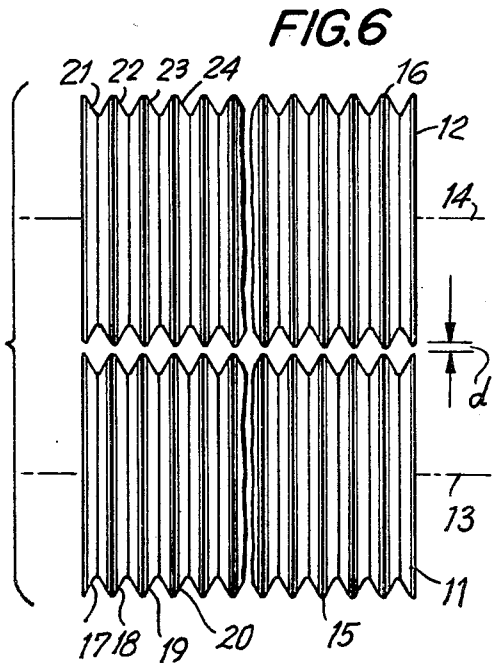
FIG. 6 is a view, on an enlarged scale, of an embodiment of the first and second rollers of the liquid adhesive coating machine of the invention.
Figure 7:
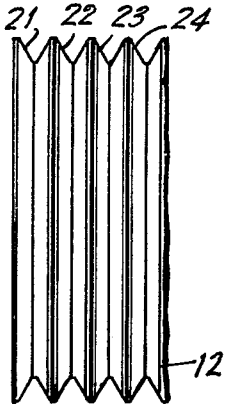
FIG. 7 is a view, on an enlarged scale, of part of the embodiment of FIG. 6 of the first and second rollers.

In accordance with the invention, as shown in FIGS. 6 and 7, each of the first and second rollers 11 and 12 has a substantially cylindrical surface 15 and 16, respectively, having a plurality of substantially circular notches 17, 18, 19, 20, and so on, and 21, 22, 23, 24, and so on, formed therein in next-adjacent equidistantly spaced relation. As shown in FIGS. 6 and 7, each of the notches 17, 18, 19, 20, and so on, and 21, 22, 23, 24, and so on, is of V shaped cross-section whereby the surface of each of the first and second rollers is a substantial sawtooth.

The notches result in the application of a plurality of spaced parallel strips of adhesive 1 to the surface 2 of the material 3, which is usually paper. The spaced strips of adhesive permit items such as photographs, written material, pictures, and the like, to be affixed to the sheet of material 3 for any desired period of time and permit separation of such items from the sheet without damage to the items or the sheet thereby especially adapting the sheet for use in preparing mockups, layouts, and the like, in graphic arts operations.

The outer surfaces 15 and 16 of the first and second rollers 11 and 12 between the notches therein are rounded, as shown in FIGS. 6 and 7. The rounded outer surfaces of the first and second rollers are substantially coplanarly aligned, as shown in FIG. 6 and are spaced from each other a minimum distance *d* of 0.003 inch (FIG. 6).

Figure 3:
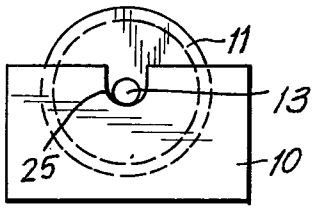
FIG. 3 is an end view of the tray with the first roller mounted therein.

Slots 25 and 26 are formed in the sides of the tray 10 for rotatably supporting the first roller 11 (FIGS. 1 and 3). Apertures 27 and 28 are formed in the sides 7 and 8 of the support member 4 for rotatably supporting the second roller 12 (FIG. 1). The rollers may be directly supported in the corresponding slots and apertures via smaller diameter pin type parts extending coaxially from both ends of each roller or via plastic bushings mounted in said slots and apertures and accommodating said pin type parts.

A rotating device, comprising a manually rotatable handle 29 (FIGS. 1 and 10) is affixed to the second roller 12 for rotating said roller in one direction 30 (FIG. 2) thereby rotating the first roller 11 in the opposite direction 31 (FIG. 2) and moving the sheet of material 3 between said rollers in a direction 32 (FIG. 2) parallel to the top T of the support member 4 and simultaneously applying liquid adhesive 1 to the surface 2 of said material via said first roller.

Figure 9:
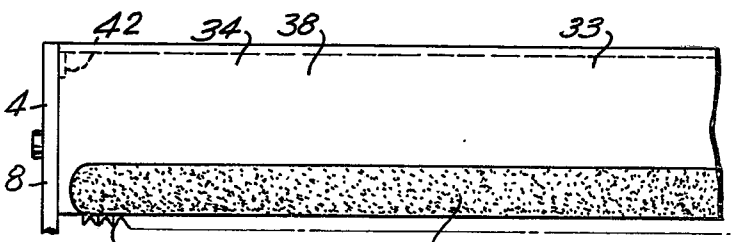
FIG. 9 is a view, taken along the lines IX—IX, of FIG. 8.
Figure 8:
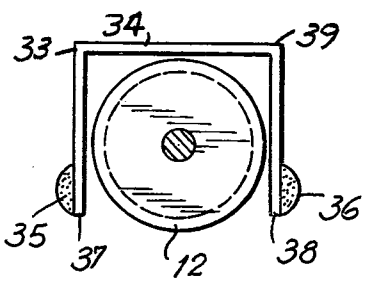
FIG. 8 is an end view of an embodiment of the humidity device of the liquid adhesive coating machine of the invention.

A humidity device 33 is mounted on the support member 4 (FIG. 9), in operative proximity with the first roller 11, as shown in FIG. 2. The humidity device 33 functions to slow down the drying out of the surfaces of the first roller 11 and to slow down water evaporation from the adhesive. As shown in FIGS. 2, 8 and 9, the humidity device 33 comprises a frame 34 supported on the sides 7 and 8 of the support member 4 over the second roller 12 and extending to operative proximity with the first roller 11 and sponges 35 and 36 mounted in said frame. The sponges 35 and 36 are moistened and thereby provide the required humidity for the first roller 11.

The sponges 35 and 36 are mounted on the sides of the frame 34 in a pair of elongated windows formed through the sides of the frame. The frame is of inverted substantially square U shape having spaced substantially parallel sides 37 and 38 (FIGS. 8 and 9) and a head 39 substantially perpendicular to the sides and joining them. As shown in FIG. 9, and as illustrated in FIG. 2, the frame 34 of the humidity device 33 is supported on the sides 7 and 8 of the support member 4 in a manner whereby said frame extends just short of the material 3. The moisture in the sponges 35 and 36 is effective to affect the first roller 11 by slowing down the drying out of the surfaces of said first roller and slowing down water evaporation from the adhesive. The frame 34 is supported by any suitably means on the sides 7 and 8 of the support member 4 such as, for example, inverted U-shaped projections on the inside surfaces of said sides, facing each other. The projection 42 of FIG. 9, shown in broken lines, represents the projection extending from the side 8.

Figure 11:
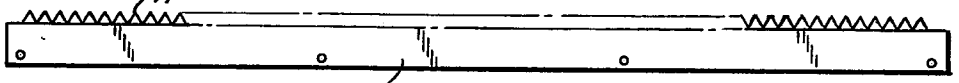
FIG. 11 is a plan view, on a reduced scale, of an embodiment of a doctor blade of the liquid adhesive coating machine of the invention.
Figure 12:
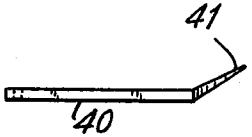
FIG. 12 is a side view of the embodiment of FIG. 11 of the doctor blade.

A doctor blade 40 (FIGS. 2, 11 and 12) is mounted on the tray 10 and the support member 4 in operative proximity with the first roller 11. The doctor blade 40 functions to clean the notches 17, 18, 19, 20, and so on, of the first roller 11 to prevent a buildup of adhesive in said notches. The doctor blade 40 is affixed to the support member 4 and to the tray 10 by four set screws. Two of the screws are secured to the tray and two are secured to the support members. These screws thus prevent shifting of the tray as well as securing the doctor blade. The doctor blade 40 also functions to control the amount of adhesive, or the thickness of the coating, applied to the sheet of material 3.

The doctor blade 40 has a sawtooth edge 41 (FIGS. 11 and 12) at an angle with the remainder of the blade. The teeth of the edge 41 extend into the notches 17, 18, 19, 20, and so on, of the first roller 11.

While the invention has been described by means of a specific example and in a specific embodiment, I do not wish to be limited thereto, for obvious modifications will occur to those skilled in the art without departing from the spirit and scope of the invention.

I claim:

1. A liquid adhesive coating machine for coating pressure sensitive liquid adhesive on one surface of a sheet of material, said liquid adhesive coating machine comprising a support member having a length, a width, a depth, a top, a bottom, a pair of spaced opposite ends and a pair of spaced opposite sides, and a trough formed therein at one end thereof extending from the top and from side to side, said trough containing liquid adhesive;

first and second rollers rotatably mounted in the machine in closely spaced adjacent parallel relation with their axes disposed in a plane perpendicular to the top and bottom of the support member, the first roller being partially immersed in liquid adhesive in the trough and the second roller being positioned above the first, each of said first and second rollers having a substantially cylindrical surface having a plurality of substantially circular notches formed therein in next-adjacent equidistantly spaced relation, each of said notches having a sustantially V-shaped cross-section whereby the surface of each of said first and second rollers is a substantial sawtooth, the outer surface of each of the first and second rollers between the notches therein being rounded and the rounded outer surfaces of the first and second rollers being substantially coplanarly aligned; and rotating means affixed to one of the rollers for rotating said one of said rollers thereby rotating the other of the rollers in the opposite direction and moving a sheet of material between said rollers in a direction parallel to the top of the support member and simultaneously applying liquid adhesive to one surface of the material via the first roller.

2. A liquid adhesive coating machine as claimed in claim 1, further comprising a tray containing liquid adhesive removably disposed in the trough, and wherein the first roller is rotatably mounted in the tray and the second roller is rotatably mounted in the support member.

3. A liquid adhesive coating machine as claimed in claim 2, wherein the first roller is approximately half immersed in liquid adhesive in the tray.

4. A liquid adhesive coating machine as claimed in claim 2, wherein the rotating means comprises a manually rotatable handle affixed to the second roller for rotating said second roller.

5. A liquid adhesive coating machine as claimed in claim 2, further comprising slots formed in the sides of the tray for rotatably supporting the first roller.

6. A liquid adhesive coating machine as claimed in claim 2, further comprising apertures formed in the sides of the support member for rotatably supporting the second roller.

7. A liquid adhesive coating machine as claimed in claim 6, wherein the humidity means comprises a frame supported on the sides of the support member over the second roller and extending to operative proximity with the first roller and sponges mounted in the frame, said sponges being moistened and thereby providing the required humidity for the first roller.

8. A liquid adhesive coating machine as claimed in claim 2, further comprising humidity means mounted on the support member in operative proximity with the first roller for providing humidity to slow down drying out of the surfaces of said first roller.

9. A liquid adhesive coating machine as claimed in claim 1, further comprising blade means mounted in operative proximity with the first roller for cleaning the notches thereof to prevent a buildup of adhesive therein and to control the thickness of the coating of adhesive applied to the sheet of material.

* * * * *